US008277090B2

(12) United States Patent
Fryzek et al.

(10) Patent No.: US 8,277,090 B2
(45) Date of Patent: Oct. 2, 2012

(54) TRANSLATING APERTURE ADJUSTMENT FOR A RECESSED LUMINAIRE

(75) Inventors: Aaron P. Fryzek, Wheaton, IL (US); Joe Stauner, Algonquin, IL (US); John Schubert, Arlington Heights, IL (US)

(73) Assignee: Juno Manufacturing, LLC, Des Plaines, IL (US)

( * ) Notice: Subject to any disclaimer, the term of this patent is extended or adjusted under 35 U.S.C. 154(b) by 377 days.

(21) Appl. No.: 12/726,830

(22) Filed: Mar. 18, 2010

(65) Prior Publication Data

US 2011/0228543 A1 Sep. 22, 2011

(51) Int. Cl.
*F21V 15/00* (2006.01)

(52) U.S. Cl. ..... 362/366; 362/148; 362/365; 362/418; 248/906

(58) Field of Classification Search ..... 248/298.1, 248/343, 906; 362/148, 364–366, 418
See application file for complete search history.

(56) References Cited

U.S. PATENT DOCUMENTS

| | | | | |
|---|---|---|---|---|
| 5,951,151 | A | 9/1999 | Doubeck et al. | 362/365 |
| 6,082,878 | A | 7/2000 | Doubek et al. | 362/365 |
| 6,652,124 | B2 * | 11/2003 | Doubek et al. | 362/365 |
| 8,021,013 | B2 * | 9/2011 | Russo et al. | 362/148 |

OTHER PUBLICATIONS

Cooper Lighting, Iris Lighting , http://www.iris_lighting.com/, printed on Mar. 19, 2010 (1 page).

USA Illumination™, USA Illumination Product Locator, http://usaillumination.com/SearchResults.aspx?SpecialFeature=73, printed on Mar. 19, 2010 (15 pages).

Cooper Lighting, IRIS®, 75W MR16 Tungsten-Halogen Specification Sheet, Feb. 29, 2008 (2 pages).

USAI®, 9363 Bevel® Low Voltage Halogen Specification Sheet, 2009 (1 page).

USAI®, 9373 Bevel® Low Voltage Halogen Specification Sheet, 2009 (1 page).

Cooper Lighting, IRIS®, 71W MR17 3" Adjustable Accent Specification Sheet, printed on Mar. 19, 2010 (2 pages).

Cooper Lighting, IRIS®, 50W MR16 3" Adjustable Accent Specification Sheet, printed on Mar. 19, 2010 (2 pages).

* cited by examiner

*Primary Examiner* — Stephen F Husar
(74) *Attorney, Agent, or Firm* — Nixon Peabody LLP

(57) ABSTRACT

A mounting assembly includes a stationary plate for supporting and linearly adjusting a recessed fixture in a parallel direction relative to structural framing members. Telescoping mounting bars are fixed to a building structure and allow adjustability of the stationary plate in a direction generally perpendicular to structural framing members. An adjustable plate has a plurality of linear guides received in a linear movable manner within a corresponding one of linear guide slots of the stationary plate. A linear locking member is adjustably secured in one of the linear guide slots such that linear movement of the adjustable plate is prevented relative to the stationary plate when the linear locking member is in a locked position, linear movement of the adjustable plate being allowed relative to the stationary plate in a direction parallel to the structural framing members when the linear locking member is in an adjustable position.

17 Claims, 6 Drawing Sheets

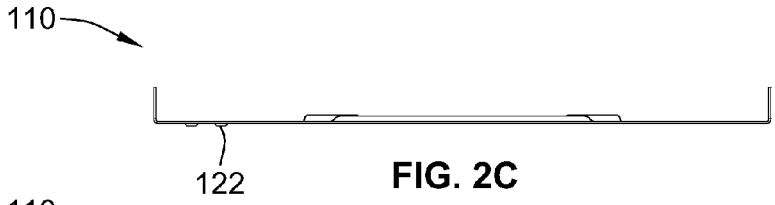
FIG. 2C
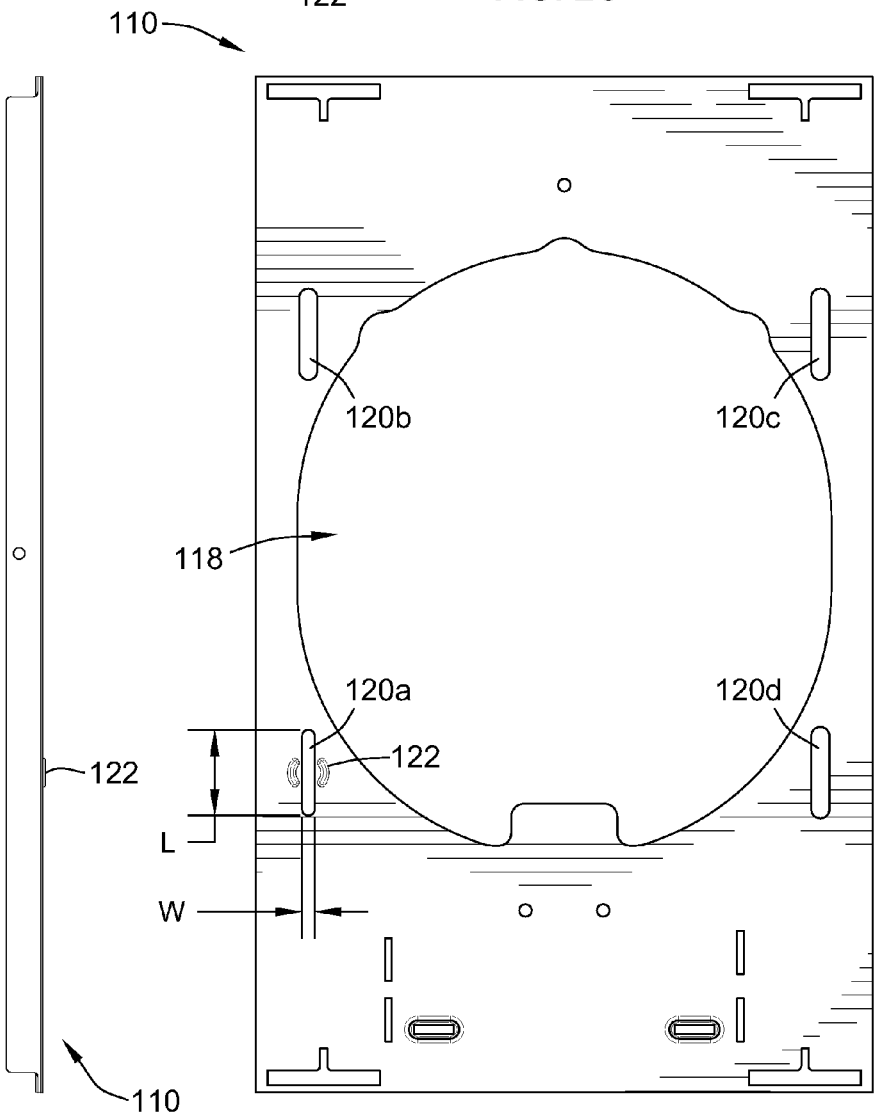
FIG. 2B
FIG. 2A

TRANSLATING APERTURE ADJUSTMENT FOR A RECESSED LUMINAIRE

FIELD OF THE INVENTION

This invention is directed generally to recessed lighting systems, and, more particularly, to a multi-directional adjustment system for the aperture of a recessed fixture.

BACKGROUND OF THE INVENTION

Typically, prior to installation of a finished ceiling, a recessed luminaire (or light fixture) is secured to wood and/or steel framing of a building using telescoping bars that cover common spacing between parallel framing members. For example, the telescoping bars cover a joist spacing in the range of about 16 inches-24 inches or a T-Bar spacing in the range of about 24 inches.

After attachment to the building framing, the recessed luminaire can be adjusted perpendicular to the framing members by sliding it along the telescoping bars. However, parallel adjustment relative to the framing members requires complete detachment of the recessed luminaire from the building framing, followed by repositioning and re-attachment of the recessed luminaire. Accordingly, parallel adjustment of the recessed luminaire can be problematic because the procedure is time consuming and labor intensive. Problems with parallel adjustment of the recessed luminaire are especially present when only slight adjustments in position are desired or when electrical connections to the recessed luminaire are already in place (when the parallel adjustment is required).

Similar problems may also be present in installation of other devices that are similarly installed to the building framing. Such devices may include audio speakers, recessed fans, electrical boxes, etc.

What is needed, therefore, is a multi-directional adjustment system for a recessed luminaire that addresses the above-stated and other problems.

SUMMARY OF THE INVENTION

In an implementation of the present invention, a multi-directional adjustment system for a recessed luminaire improves the adjustability of recessed luminaires prior to the installation of a finished ceiling (or wall). The adjustment system incorporates features that allow adjustment of the recessed luminaire in at least two directions relative to structural framing members, which are generally parallel to each other. The adjustment directions of the adjustment system include (i) an adjustment direction parallel to the framing members and (ii) an adjustment direction perpendicular to the framing members.

Although the adjustment system is described generally as being applicable to luminaires, the adjustment system can also be applicable to other devices that are recessed prior to installation of a finished surface, such as a ceiling or a wall. Other devices can include audio speakers, recessed fans, and electrical boxes.

The adjustment system includes a stationary plate, an adjustable plate, and a locking component (such as a locking screw). The adjustable plate has a plurality of guides that are movably attached to corresponding guide slots of the stationary plate. The adjustable plate is secured to the stationary plate via the locking screw. The positional relationship between the stationary plate and the adjustable plate is controlled by the locking screw. During manufacturing and initial installation, the locking screw is positioned (or nesting) into a formed area of the stationary plate. The stationary plate and the adjustable plate allow the recessed luminaire to be adjusted parallel to the framing members.

The adjustment system further includes a plurality of telescoping bars for securing the recessed luminaire to the framing members. The telescoping bars allow the recessed luminaire to be adjusted perpendicular to the framing members. To achieve perpendicular adjustment, the telescoping bars are adjusted to the desired position.

When the recessed luminaire is secured to the framing members, the parallel adjustment can be achieved by (i) loosening the locking screw, (ii) sliding the adjustable plate in the desired position relative to the stationary plate, and (iii) tightening the locking screw. The movement between the adjustable plate and the stationary plate is allowed when the locking screw is loosened and the guides of the adjustable plate slide in the corresponding guide slots of the stationary plate.

The overall length and direction of adjustment is controlled by the size and shape of the guide slots of the stationary plate. For example, according to one embodiment, the parallel adjustment can be in the range of about plus/minus 0.50 inches from a factory pre-set centered position.

In another aspect of our invention, a mounting assembly includes a stationary plate for supporting a recessed fixture and having a plurality of linear guide slots. Telescoping mounting bars are fixed to building structure framing members and allow adjustability of the stationary plate in a direction generally perpendicular to a pair of structural framing members. An adjustable plate has a plurality of guide-receiving holes received in a linear movable manner within a corresponding one of the linear guide slots. A locking member is adjustably secured in one of the linear guide slots such that linear movement of the adjustable plate is prevented relative to the stationary plate when the locking member is in a locked position, linear movement of the adjustable plate being allowed relative to the stationary plate in a direction generally parallel to the structural framing members when the locking member is in an adjustable position.

In another aspect of our invention, a mounting assembly for a recessed fixture includes a stationary plate having a plurality of linear guide slots, and a first pair of telescoping bars attached to the stationary plate along a first edge. A second pair of telescoping bars is attached to the stationary plate along a second edge, the second edge being parallel to the first edge. A first pair of mounting feet and a second pair of mounting feet are attached respectively to the first pair of telescoping bars and the second pair of telescoping bars for rigidly mounting the respective telescoping bars to a pair of parallel structural framing members. The telescoping bars allow adjustment of the stationary plate in a perpendicular direction relative to the structural framing members. An adjustable plate is mounted to the stationary plate via a plurality of linear guides, each of the linear guides being linearly movable within a corresponding linear guide slot of the plurality of linear guide slots. A locking member is attached in one of the plurality of linear guide slots, the locking member preventing movement between the stationary plate and the adjustable plate in a locked position, the locking member allowing linear movement between the stationary plate and the adjustable plate in an adjustable position. The linear movement between the stationary plate and the adjustable plate is in a direction parallel to the structural framing members and is achievable when the mounting feet are rigidly mounted to the structural framing members.

Additional aspects of our invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

FIG. 2A is a front view of a stationary plate.

FIG. 2B is a side view of the stationary plate.

FIG. 2C is a top view of the stationary plate.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
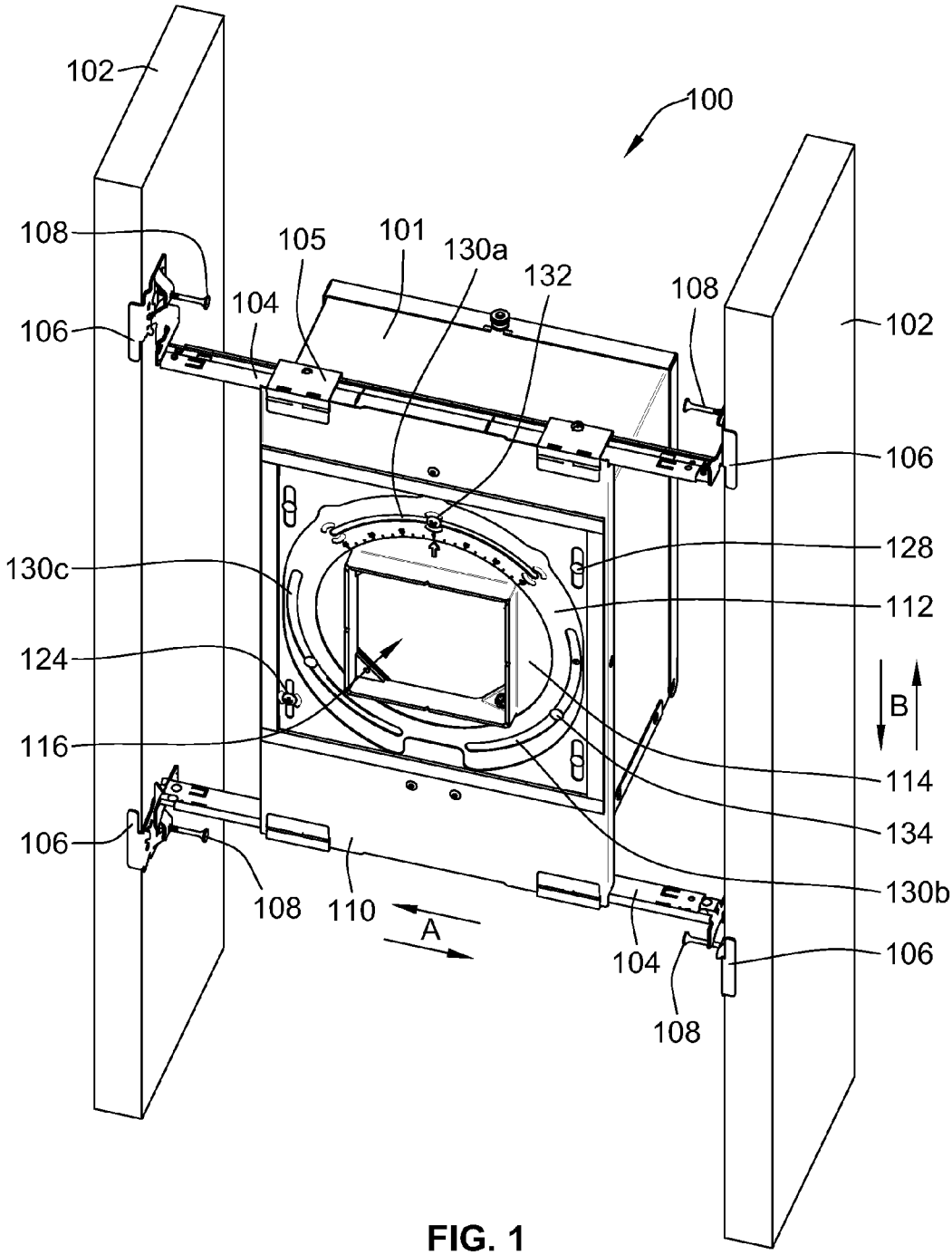
FIG. 1 is a bottom perspective view of a recessed luminaire.

Referring to FIG. 1, a recessed fixture in the form of a recessed luminaire 100 includes a luminaire housing 101 that is mounted to a pair of structural framing members 102. In other embodiments, for example, the recessed fixture can also be an audio speaker, an electrical fan, or an electrical box. The electrical box can be, for example, a junction box, an outlet box, or a switch box. The structural framing members 102 are typical support members in a building and can include wood and/or steel framing members. The framing members 102 are separated by a distance commonly referred to as a joist spacing (typical in wood framing members) or a T-Bar spacing (typical in steel framing members having a T-Bar cross-sectional shape).

Prior to installation of a finished ceiling (or other covering surface), the recessed luminaire 100 is secured to the framing members 102 via a mounting assembly that includes two pairs of telescoping bars 104. The telescoping bars 104 are fixedly attached to the framing members 102 using mounting feet 106, which are connected to each end of the telescoping bars 104 and secured to the framing members 102 using mechanical fasteners 108, such as nails or screws. Preferably, the mechanical fasteners 108 are nails. In the illustrated embodiment, the mounting feet 106 include two pairs of mounting feet attached respectively to the two pairs of telescoping bars 104. The telescoping bars 104 are attached to the luminaire housing 101 using two pairs of mounting guides 105.

After attaching the mounting feet 106 to the framing members 102, the luminaire housing 101 and other luminaire components (including luminaire apertures) can be adjusted in a linear direction "A" perpendicular to the framing members 102. The adjustment "A" of the telescoping bars 104 typically covers a joist spacing in the range of about 16-24 inches and a T-Bar spacing is about 24 inches.

The recessed luminaire 100 further includes a stationary plate 110 and an adjustable plate 112 for adjusting luminaire components in a linear direction "B" parallel to the framing members 102. As explained in more detail below, the adjustment "B" of the adjustable plate 112 relative to the stationary plate 110 is achieved without having to physically detach and move the mounting feet 106 relative to the framing members 102.

Figure 4:
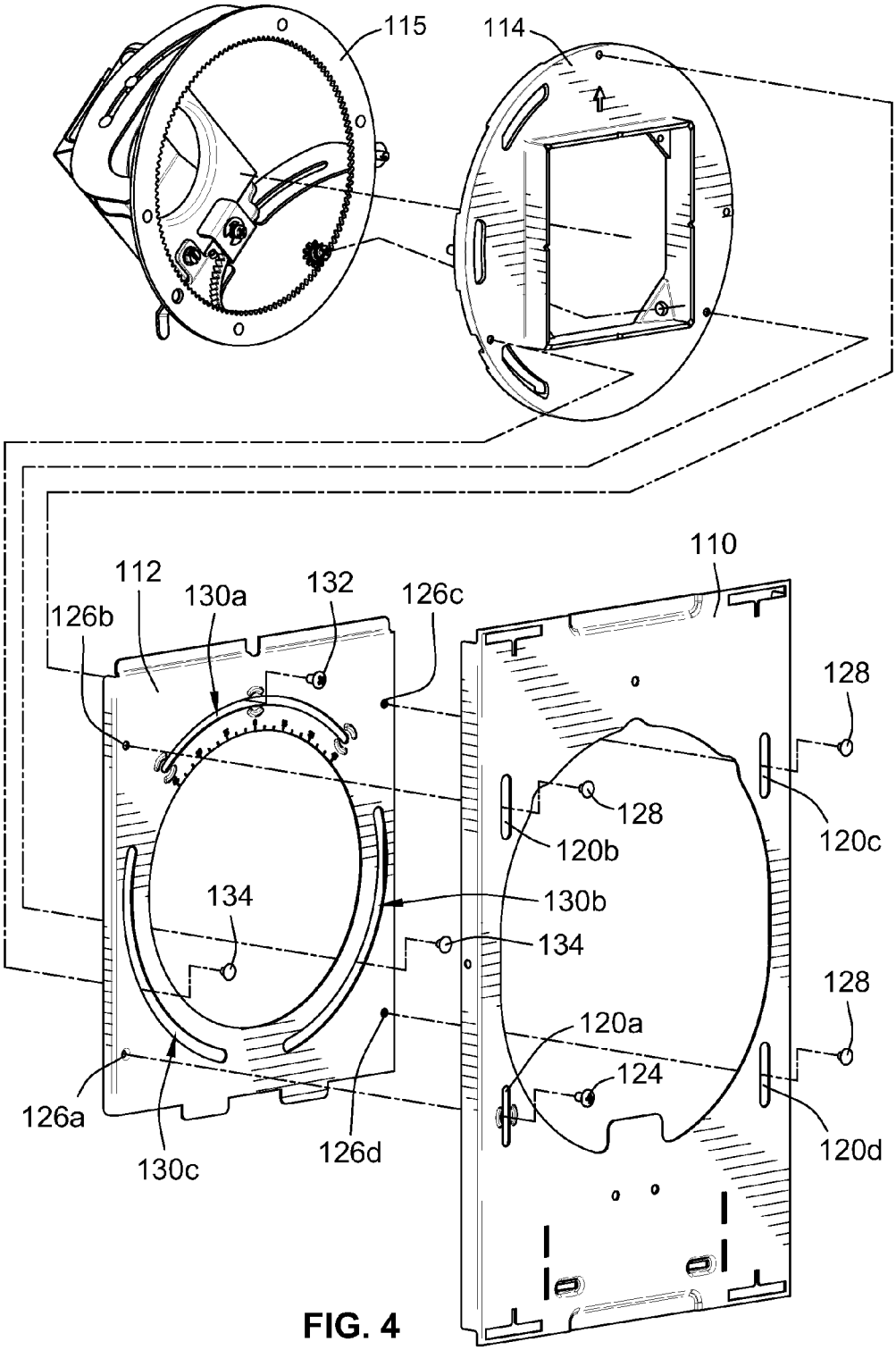
FIG. 4 is an exploded perspective view showing the stationary plate, the adjustable plate, and other components of the recessed luminaire.

The recessed luminaire 100 may include other components, such as a frame insert 114 and a mechanical adjustment mechanism 115 (shown in FIG. 4). The frame insert 114 has a central frame aperture 116 that typically requires alignment adjustment during installation of the recessed luminaire 100. Although the frame aperture 116 can have various shapes, the adjustments "A" and "B" are especially useful when the frame aperture 116 has a shape other than a round shape. For example, alignment is more critical to producing an acceptable layout when alignment is required between square frame apertures 116 of luminaires that are mounted proximate to each other in the same general area.

Referring to FIGS. 2A-2C, the stationary plate 110 is generally a rectangular plate having a central stationary aperture 118 and four linear guide slots 120*a*-120*d*. The central stationary aperture 118 has a generally elliptical shape (i.e., for accommodating movement of a smaller aperture of the adjustable plate 112) and the linear guide slots 120*a*-120*d* are in the form of generally linear elongated slots having a length "L" and a width "W". According to one embodiment, the length "L" is about one inch.

The linear guide slots 120*a*-120*d* are positioned symmetrically around the central stationary aperture 118 in an array of two rows and two columns. A first linear guide slot 120*a* is generally aligned with a second linear guide slot 120*b* and with a fourth linear guide slot 120*d*. Similarly, a third linear guide slot 120*c* is generally aligned with the second linear guide slot 120*b* and the first linear guide slot 120*a*. Although the shown embodiment has four linear guide slots arranged in a 2×2 array, other embodiments can have different numbers and arrangements of linear guide slots.

The first linear guide slot 120*a* includes a formed area 122 for receiving a linear locking member 124 (shown in FIG. 1). The formed area 122 is generally a factory pre-set form (e.g., a standoff for a screw) on the stationary plate 110 to indicate a factory pre-set position (which is typically a position in which the adjustable plate 112 is centered relative to the stationary plate 110). The formed area 122 receives the linear locking member 124 when the linear locking member 124 is positioned in the factory pre-set position.

The linear locking member 124 can be a fastener, such as a screw or a rivet, that fixes in place the adjustable plate 112 relative to the stationary plate 110. When the linear locking member 124 is in a locked position (e.g., screwed in), linear movement is prevented between the adjustable plate 112 and the stationary plate 110. When the linear locking member 124 is in an adjustable position (e.g., loosened), linear movement is allowed between the adjustable plate 112 and the stationary plate 110 in the "B" linear direction.

Figure 3C:
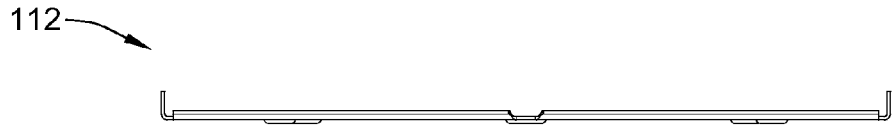
FIG. 3C is a top view of the adjustable plate.
Figure 3B:
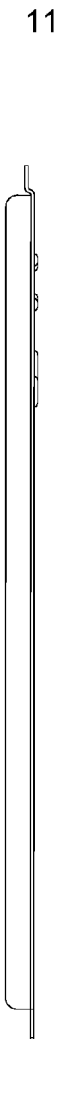
FIG. 3B is a side view of the adjustable plate.
Figure 3A:
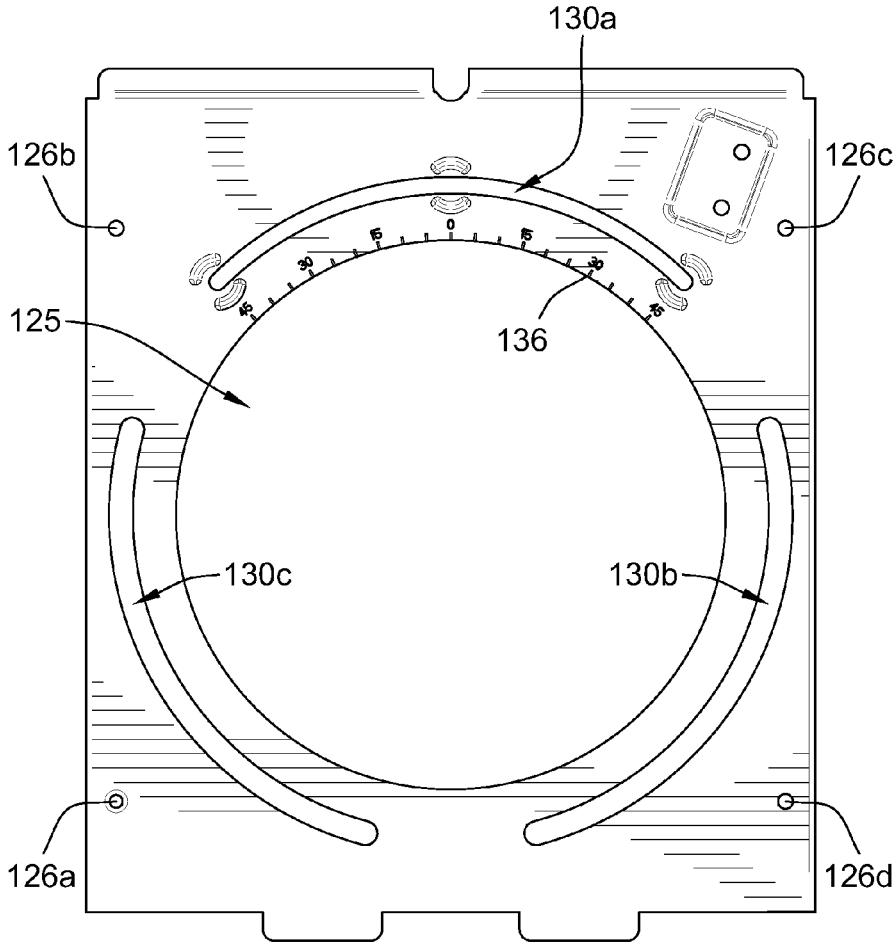
FIG. 3A is a front view of an adjustable plate.

Referring to FIGS. 3A-3C, the adjustable plate 112 is generally a rectangular plate having a central adjustable aperture 125 and four linear guide-receiving holes 126*a*-126*d*. The central adjustable aperture 125 has a generally circular shape and the linear guide-receiving holes 126*a*-126*d* are arranged in an array of two rows and two columns to match the array of linear guide slots 120*a*-120*d*. A first linear guide-receiving hole 126*a* is a tapped hole for receiving the linear locking member 124, having an internal thread that matches an external thread of the linear locking member 124. The other linear guide-receiving holes 126*b*-126*d* are untapped through-holes for receiving a respective linear guide 128 (shown in FIG. 1). The linear guides 128 are mechanically attached to the adjustable plate 112 in the respective linear guide-receiving holes 126*b*-126*d* and are adapted to slide in the corresponding linear guide slots 120*b*-120*d* of the stationary plate 110. According to one example, the linear guides 128 can be metal guide pins (e.g., a cylindrical rod having a larger circular head attached at one end of the rod).

Optionally, the adjustable plate 112 includes curved guide slots 130*a*-130*c* for allowing rotational adjustment of the adjustment mechanism 115 (FIG. 4) relative to the adjustable plate 112. The curved guide slots 130*a*-130*c* are concentrically arranged around the central adjustable aperture 125 and include a first curved guide slot 130*a* that is adapted for receiving a rotational locking member 132 (shown in FIG. 1). The other curved guide slots 130*b*-130*c* are adapted to receive a respective rotational guide 134 (shown in FIG. 1).

The rotational locking member 132 prevents or allows rotational movement between the adjustable plate 112 and other components of the recessed luminaire 100, such as the adjustment mechanism 115 and/or the frame insert 114. When the rotational locking member 132 is in a locked position, rotational movement of the adjustable plate 112 along the path of the curved guide slots 130*a*-130*c* and relative to the adjustment mechanism 115 is prevented. When the rotational locking member 132 is in an adjustable position, rotational movement of the adjustable plate 112 relative to the adjustment mechanism 115 is allowed.

The adjustable plate 112 includes, optionally, angular markings 136 for identifying an adjustment in rotation of the adjustment mechanism 115. The angular markings 136 are located around the periphery edge of the central adjustable aperture 125.

Referring to FIG. 4, the stationary plate 110 is mounted to the adjustable plate 112 via the linear locking member 124 and the linear guides 128. The linear adjustment of the adjustable plate 112 relative to the stationary plate 110 in the "B" direction is made along a linear path established by the linear guide slots 120*a*-120*d*.

The adjustable plate 112 is mounted to the frame insert 114 and the adjustment mechanism 115 via the rotational locking member 132 and the rotational guides 134. The rotational adjustment of the frame insert 114 relative to the adjustable plate 112 is made along the curved path established by the curved guide slots 130*a*-130*c*.

Figure 5A:
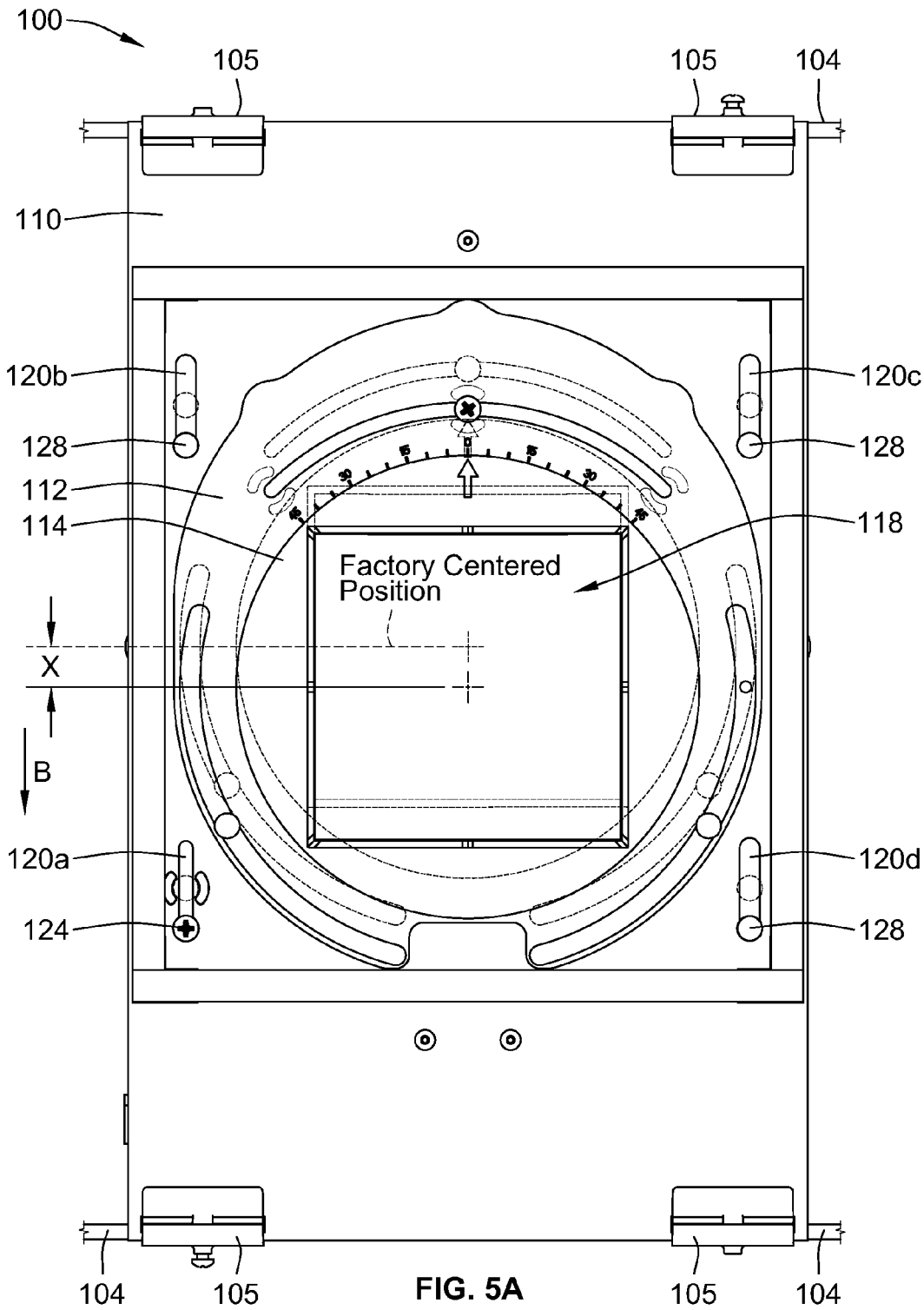
FIG. 5A is a front view of the recessed luminaire illustrating linear adjustment in a first direction.
Figure 5B:
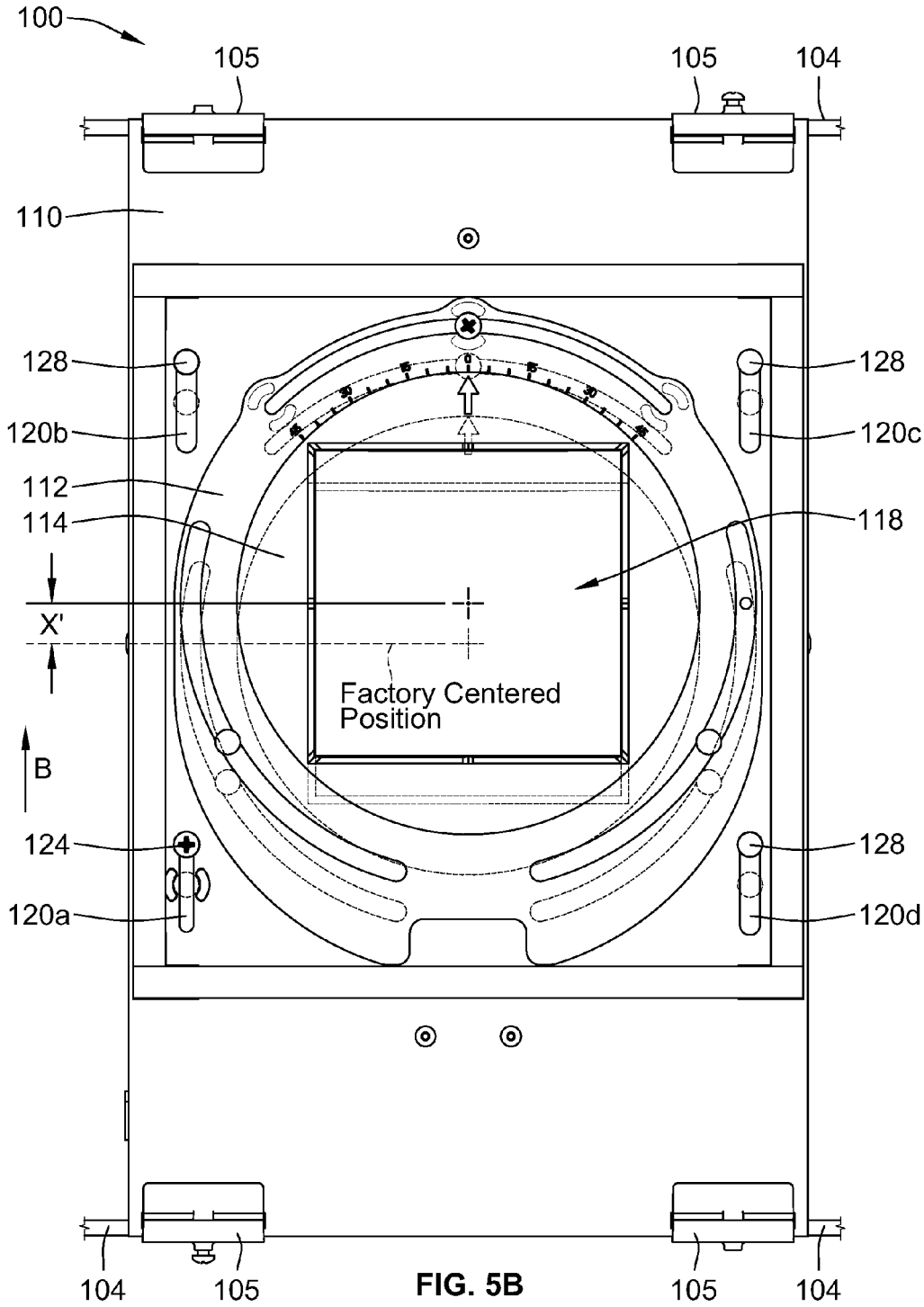
FIG. 5B illustrates linear adjustment of the recessed luminaire of FIG. 5A in a second direction opposite to the first direction.

Referring to FIGS. 5A and 5B, the recessed luminaire 100 can be adjusted along the "B" direction (in either direction) within the tolerances allowed by the linear guide slots 120*a*-120*d*. For example, the adjustable plate 112 can be adjusted relative to the stationary plate 110 a distance "X" in a first "B" direction (shown in FIG. 5A) or a distance "X"' in a second (and opposite) "B" direction (shown in FIG. 5B). Assuming that the length "L" of the linear guide slots 102*a*-120*d* is about one inch, the allowed adjustment "B" is about +/−0.50 inches from the factory pre-set position.

To adjust the adjustable plate 112, the linear locking screw 124 is loosened while the adjustable plate 112 is moved to the desired position (such as at distance "X" or "X"). After the adjustable plate 112 is in the desired position, the linear locking screw 124 is tightened to secure the adjustable plate 112 in a fixed position relative to the stationary plate 110.

The recessed luminaire 100 provides numerous advantages, including allowing multi-direction adjustment of luminaire apertures while the recessed luminaire 100 remains secured to the framing members 102, and allowing precise lighting layouts and luminaire-to-luminaire alignment with minimal installation labor. The linear adjustment features of the recessed luminaire 100 allow corrections to installation tolerances and a desired luminaire aperture location to be achieved despite obstructions in the building structure. The linear adjustment features of the recessed luminaire 100 further allow parallel adjustment of the luminaire aperture after a rigid electrical supply has been connected to the recessed luminaire 100.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A mounting assembly for a recessed fixture, the assembly comprising:

a stationary plate for supporting a recessed fixture and having a plurality of linear guide slots;

telescoping mounting bars fixedly attached to the stationary plate for mounting the stationary plate to and between spaced apart framing members, the stationary plate being adjustable via the telescoping mounting bars in a direction generally perpendicular to the structural framing members;

an adjustable plate mounted to the stationary plate and having a plurality of linear guide-receiving holes, each of the linear guide-receiving holes receiving a respective linear guide that is linearly movable within a corresponding one of the linear guide slots; and a linear locking member adjustably secured in one of the linear guide slots, the linear locking member having a locked position and an adjustable position, the locked position preventing linear movement of the adjustable plate relative to the stationary plate, the adjustable position allowing linear movement of the adjustable plate relative to the stationary plate in a direction generally parallel to the structural framing members.

2. The mounting assembly of claim 1, wherein the plurality of linear guide-receiving holes includes four linear guide-receiving holes and the plurality of linear guide slots includes four linear guide slots.

3. The mounting assembly of claim 1, wherein the stationary plate has a central stationary aperture and the adjustable plate has a central adjustable aperture, the central adjustable aperture being centered relative to the central stationary aperture when the plurality of linear guide-receiving holes are in a centered position relative to the respective linear guide slots.

4. The mounting assembly of claim 3, wherein the central stationary aperture is larger than the central adjustable aperture.

5. The mounting assembly of claim 1, wherein the linear guide slots define a length of adjustability in one axis of the central stationary aperture.

6. The mounting assembly of claim 1, wherein the telescoping mounting bars have an adjustable range for mounting to a joist or T-Bar spacing of about 16 inches to about 24 inches.

7. The mounting assembly of claim 1, wherein the recessed fixture is selected from a group consisting of a luminaire, an audio speaker, an electrical fan, and an electrical box.

8. The mounting assembly of claim 1, further comprising:

a mechanical adjustment mechanism; and a frame insert having a frame aperture and attached to the adjustment mechanism;

wherein the adjustable plate includes a plurality of curved guide slots and a central adjustable aperture, the adjustable plate being attached to the frame insert and to the adjustment mechanism such that the frame aperture of the frame insert can be rotationally adjusted relative to the central adjustable aperture of the adjustable plate.

9. The mounting assembly of claim 8, wherein the aperture of the frame insert has a generally rectangular shape and the central adjustable aperture of the adjustable plate has a generally circular shape.

10. The mounting assembly of claim 1, wherein the stationary plate includes a formed area for receiving the linear locking member 124, the linear locking member 124 being positioned in the formed area in a factory preset position.

11. A mounting assembly for a recessed fixture, the assembly comprising:

a stationary plate for a recessed fixture and having a plurality of linear guide slots;

a first pair of telescoping bars attached to the stationary plate along a first edge and a second pair of telescoping bars attached to the stationary plate along a second edge, the second edge being parallel to the first edge;

a first pair of mounting feet and a second pair of mounting feet attached respectively to the first pair of telescoping bars and the second pair of telescoping bars for rigidly mounting the respective telescoping bars to a pair of parallel structural framing members, the telescoping bars allowing adjustment of the stationary plate in a perpendicular direction relative to the structural framing members;

an adjustable plate mounted to the stationary plate via a plurality of linear guides, each of the linear guides being linearly movable within a corresponding linear guide slot of the plurality of linear guide slots; and a locking member attached in one of the plurality of linear guide slots, the locking member preventing movement between the stationary plate and the adjustable plate in a locked position, the locking member allowing linear movement between the stationary plate and the adjustable plate in an adjustable position, the linear movement between the stationary plate and the adjustable plate being in a direction parallel to the structural framing members and being achievable when the mounting feet are rigidly mounted to the structural framing members.

12. The mounting assembly of claim 11, wherein the adjustable plate includes a mounting hole for receiving the locking member.

13. The mounting assembly of claim 12, wherein the mounting hole is a threaded hole and the locking member is a screw.

14. The mounting assembly of claim 11, further comprising a mechanical adjustment mechanism, the adjustable plate having a plurality of curved guide slots for receiving correspondingly rotational guides attached to the adjustment mechanism, at least one of the rotational guides being a locking rotational member, the adjustment mechanism being rotationally adjustable relative to the adjustable plate when the locking rotational member is in an adjustable position, the adjustment mechanism being fixed relative to the adjustable plate when the locking rotational member is in a locked position.

15. The mounting assembly of claim 11, wherein the stationary plate has a central stationary aperture and the adjustable plate has a central adjustable aperture, the central adjustable aperture having a generally rectangular shape sized to move within the central stationary aperture.

16. The mounting assembly of claim 11, wherein the linear guide slots define a length of adjustability in one axis of the central stationary aperture.

17. The mounting assembly of claim 11, wherein the recessed fixture is selected from a group consisting of a luminaire, an audio speaker, an electrical fan, and an electrical box.

* * * * *